United States Patent [19]

Turunen et al.

[11] 4,144,124

[45] Mar. 13, 1979

[54] MACHINE FOR MANUFACTURING PAPER SUCH AS TISSUE PAPER

[75] Inventors: Risto Turunen; Pertti Soikkanen; Martti Koponen, all of Jyväskylä, Finland

[73] Assignee: Valmet Oy, Finland

[21] Appl. No.: 845,037

[22] Filed: Oct. 25, 1977

[30] Foreign Application Priority Data

Feb. 24, 1977 [FI] Finland ..... 770610

[51] Int. Cl.[2] ..... D21F 2/00; D21F 9/00

[52] U.S. Cl. ..... 162/290; 162/301; 162/305; 162/359; 162/360 R; 162/362

[58] Field of Search ..... 162/290, 301, 305, 348, 162/352, 359, 360 R, 362, 203, 206

[56] References Cited

U.S. PATENT DOCUMENTS

| | | | |
|---|---|---|---|
| 3,224,928 | 12/1965 | Lee et al. | 162/359 X |
| 3,378,435 | 4/1968 | Loynd | 162/348 X |
| 3,434,922 | 3/1969 | Ely | 162/290 X |
| 3,537,954 | 11/1970 | Justus | 162/305 |
| 3,997,390 | 12/1976 | Kankaanpaa | 162/203 X |
| 4,055,461 | 10/1977 | Turunen | 162/290 |
| 4,056,433 | 11/1977 | Koponen et al. | 162/290 |

*Primary Examiner*—Richard V. Fisher
*Attorney, Agent, or Firm*—Steinberg & Blake

[57] ABSTRACT

A machine for manufacturing paper, such as tissue paper, includes a twin-wire former made up of a rotary forming roll and a pair of endless fabrics, each of which may be a wire or felt, lapped around the rotary forming roll to provide twin-wire web formation therewith. At the location where these endless fabrics travel beyond the forming roll they diverge from each other to define between themselves a diverging space where one of the endless fabrics has an upwardly directed surface on which the web is carried beyond the forming roll. This latter endless fabric carries the web to a press section where this latter endless fabric travels with the web through a first press nip of the press section defined between an inner press roll situated within the loop of the latter endless fabric and an outer press roll situated outside of the latter loop. This outer press roll is lapped by an additional endless fabric structure so that the web is situated at the first press nip between the latter additional fabric structure and the endless fabric which carries the web away from the forming roll. The web travels with the additional fabric structure around the outer press roll, to become detached from the endless fabric which carries the web away from the forming roll, and this outer press roll cooperates with a drying cylinder of a drying section of the paper machine to define therewith at least a second press nip.

10 Claims, 1 Drawing Figure

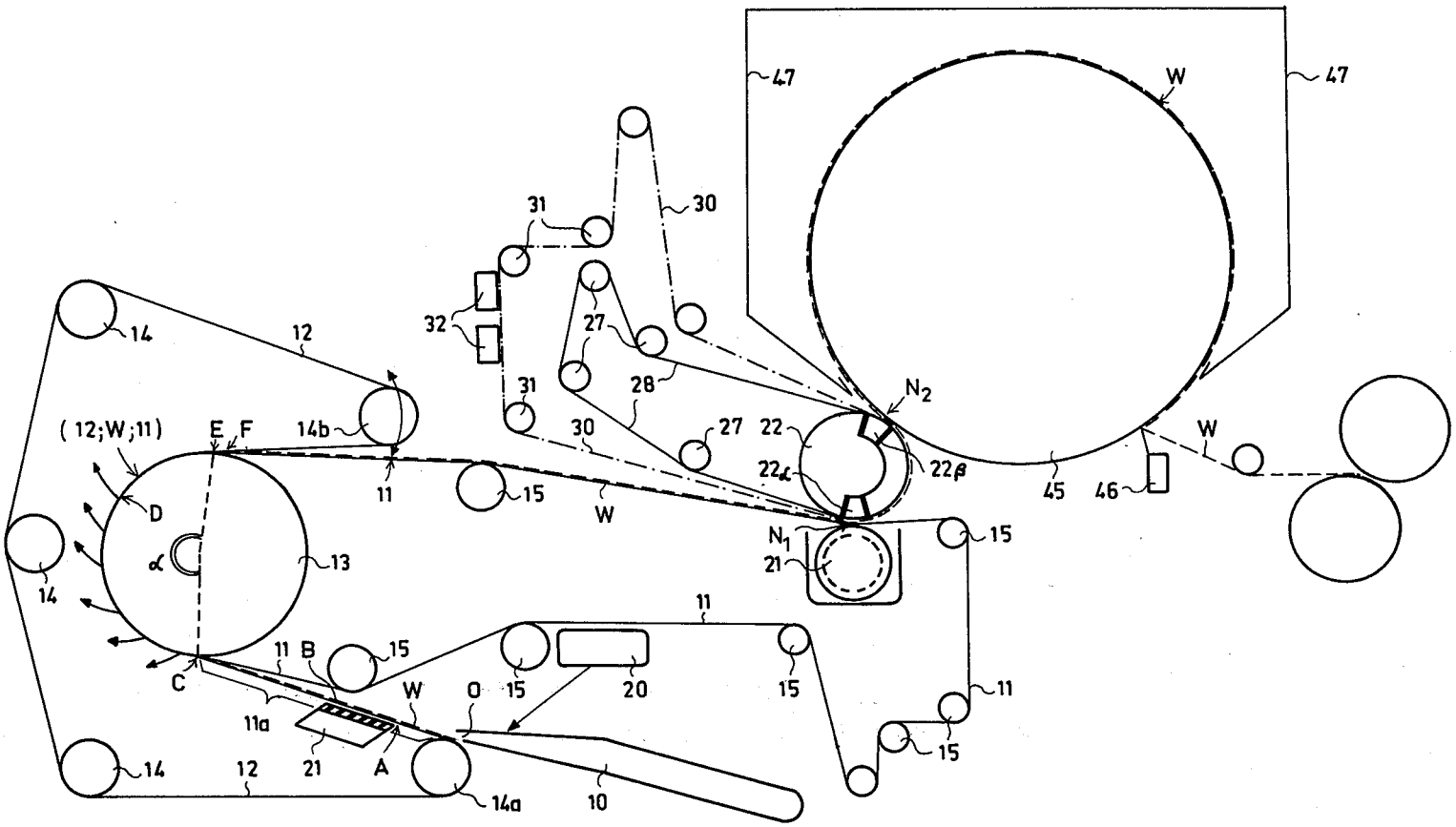
47
W
46
45
15
11
22β
N2
22
22α
N1
21
27
28
30
31
32
20
10
14a
O
A
B
11a
12
13
14b
E
F
C
D
α
(12;W;11)
14

MACHINE FOR MANUFACTURING PAPER SUCH AS TISSUE PAPER

BACKGROUND OF THE INVENTION

The present invention relates to paper-manufacturing machines.

In particular, the present invention relates to paper manufacturing machines designed to manufacture tissue paper.

The machine to which the present invention relates includes a twin-wire forming section preceded by a single-wire forming section which serves to decrease the amount of dewatering which is required at the twin-wire forming section. Thus, a pair of endless fabrics, each of which may take the form either of a wire or felt, are lapped around a rotary forming roll to form a twin-wire former therewith, and one of these endless fabrics provides in advance of the forming roll a single-wire former with which, preferably, a dewatering structure such as a forming board cooperates. A headbox, which is preferably a hydraulic headbox, cooperates with that one of the endless fabrics where the single-wire web formation takes place to supply pulp stock thereto.

In the manufacture of tissue paper it is well known to form the web on a relatively short wire section resembling a standard planar wire to which the headbox supplies the pulp stock at the region of a breast roll which is often formed with openings at its surface or which is provided with an internal vacuum, the web forming formation being carried by the wire past conventional dewatering members such as table rolls, deflectors, foil laths, suction boxes, and a suction roll, each of which removes water from the web. At the end of this wire section the partially dried web is transferred onto a pick-up felt, to be supported thereby while proceeding further towards the press and drying sections where additional drying takes place. In certain known constructions the above planar wire section has been entirely omitted. In this case the formation of the web is initially carried out entirely on a wire-covered suction breast roll from which the web is directly transferred onto the pick-up felt.

Conventional constructions of the above type have a drawback in that, for example, the upper speed limit of the paper machine will be about 1500 meters per minute. This relatively low maximum speed is necessitated because a relatively high draining pressure is essential, and this high draining pressure in turn causes an excessively great adherence of the web to the wire with resulting difficulties being encountered in connection with the detachment of the web from the wire.

A further drawback of convention structures of the above type resides in the fact that the use of a separate pick-up means results in losses of energy as well as of fibers, and increases the first cost of the machine.

Furthermore, conventional machines of the above type have certain limitations with respect to the use of inferior quality raw materials such as ground wood, deciduous wood, and waste paper pulp, owing to poor initial wet strength and also to poor ultimate strength. This drawback is primarily due to the well-known pick-up difficulties (occurrence of holes, web transfer, etc.) as well as to difficulties encountered in the reeling of the paper and its further conversion.

Several types of twin-wire formers intended for the manufacture of tissue paper are well known. Most of these known twin-wire formers are so-called full throat formers, but these structures generally have the drawback that as a result of the throat forming process there is a poor formation of the web, and the web becomes excessively adherent to the wire, this latter undesirable result being caused by the extremely high dewatering rate at the initial web-forming stage. Moreover, with such structure difficulties are encountered at the web-transfer steps.

With respect to the prior art reference may be made to U.S. Pat. Nos. 3,378,435 and 3,537,954, the first of these patents disclosing a construction generally known as as a "Crescent" former.

Also, reference may be made to U.S. Pat. No. 3,997,390 which discloses single-wire formation as an initial procedure with the possibility of controlling various process variables already used by practicing paper makers on Fourdrineer paper machines. In this connection the most essential process variables are the pulp stock discharge velocity with respect to the wire, the angle of incidence of the stock jet on the wire, and the rate at which water is drained from the suspension which is deposited on the wire.

SUMMARY OF THE INVENTION

In general it is an object of the present invention to provide improvements in known paper machines, particularly in paper machines designed to manufacture tissue paper.

More specifically, it is a primary object of the invention to provide a former section wherein it is possible to use lower draining pressures that has heretofore been required at the initial stage of the forming process, while providing the possibility for increasing the draining pressure toward the end of the forming process, so that in this way detachment of the web from one wire of a twin-wire former section in such a way that it continues to be carried by the other wire thereof is facilitated.

One of the most important objects of the present invention is to combine with procedures of the above type closed web conduction, which is to say web travel without any open draw, so that pick-up difficulties are eliminated.

It is a further object of the present invention to influence the structural properties of the paper particularly by way of embossing the same, so as to increase the absorptivity and strength of the paper.

Several other objects of the present invention include achieving a former wherein the dry matter content of the web is higher than has heretofore been possible prior to drying for example at a Yankee cylinder, providing a machine of simple and inexpensive construction primarily as a result of minimizing the number of expensive suction rolls which are required as well as the number of additional members which are subject to wear, and providing for the paper machine of the invention the advantages of perfusion drying by applying a pattern embosser which is inexpensive and results in lower operating costs.

According to the invention, the web that is formed at a twin-wire former section of the machine is transferred on the top surface of an endless fabric means from the twin-wire former, without any open draw, to the press section of the machine and in particular to the first press nip defined by a pair of press rolls, in such a way that at the first press nip the web is interposed between the fabric which carries it from the twin-wire former and an endless fabric means forming part of the press means, the web being detached at the first press nip from the web which carries it to the press nip from the twin-wire former and continuing with the endless fabric means of the press means to a drying means where a second press nip is formed, for example between a Yankee cylinder and a press roll, while a specific pattern may be embossed on the web for example at the first press nip.

Thus, the paper-manufacturing machine of the invention includes a twin-wire former means which includes a rotary forming roll means and inner and outer endless fabric means lapped around this forming roll means with the inner endless fabric means being situated at the forming roll means between the latter and the outer endless fabric means for carrying out twin-wire web formation between the inner and outer fabric means where they are lapped around the forming roll means. Each of these endless fabric means has an inner surface defining a closed loop and an outer surface directed away from the closed loop with twin-wire web formation taking place between the outer surfaces of the above inner and outer endless fabric means where they are lapped around the forming roll means. The inner and outer endless fabric means define between their outer surfaces where the inner and outer fabric means approach the forming roll means a converging space leading toward a starting end of a common path of travel of the inner and outer endless fabric means around the forming roll means where twin-wire web formation is initiated. One of the endless fabric means has at this converging space an upwardly directed outer surface, and a headbox means deposits pulp stock onto the latter upwardly directed outer surface for providing for single-wire web formation on the latter upwardly directed outer surface prior to twin-wire web formation, so that an initial dewatering action takes place during the single-wire web formation prior to further dewatering during the twin-wire web formation. The outer surfaces of the above inner and outer endless fabric means also define between themselves a diverging space where the inner and outer endless fabric means travel away from the forming roll means from a location where the inner and outer endless fabric means travel apart from each other at the end of the twin-wire formation at the location where the end of the lapping of the forming roll means by the inner and outer endless fabric means is situated. One of the endless fabric means has at the above diverging space an upwardly directed outer surface on which the web formed during twin-wire web formation rests while travelling beyond the forming roll means. A press section includes an inner press roll situated within the loop of that one of the above endless fabric means which carries the web beyond the forming roll means, the latter endless fabric means engaging the inner press roll of the press section. This press section includes also an outer press roll situated at the outside of the latter loop and cooperating with the inner press roll to define therewith the first nip of the press section. An additional endless fabric means is lapped around the outer press roll to provide for the web at te first press nip a path of travel between this additional endless fabric means and the endless fabric means which engages the inner press roll. The web travels beyond the first nip with the additional endless fabric means around the outer press roll to become detached from the endless fabric means which carries the web beyond the forming roll means. A drying section includes at least one rotary drying cylinder which cooperates with the outer press roll to define with the latter at least a second press nip where the web is detached from the above additional endless fabric means to travel around the drying cylinder in the drying section.

BRIEF DESCRIPTION OF DRAWING

The invention is illustrated by way of example in the accompanying drawing which forms part of this application and in which one possible embodiment of the invention is shown in a schematic elevation.

DESCRIPTION OF PREFERRED EMBODIMENTS

The particular machine illustrated is a tissue paper machine.

The former part of the illustrated paper machine includes a hydraulic headbox 10 and a twin-wire former which includes the smooth-surfaced forming roll means 13 which is rotated about its axis in any suitable way. The forming roll means 13 rotates in a clockwise direction, as viewed in the drawing. The twin-wire forming means includes in addition to the forming roll means 13 an inner endless fabric means 11 and an outer endless fabric means 12. Each of the latter endless fabric means may be in the form of a wire or felt. During twin-wire web formation the inner endless fabric means 11 is situated directly next to the forming roll means 13 while the web W is compressed between the inner endless fabric means 11 and the outer endless fabric means 12, the fabric means 11 being situated between the forming roll means 13 and the fabric means 12 at the location where the pair of endless fabric means 11 and 12 are lapped around the forming roll means 13 to provide the twin-wire web formation. The inner surface of the outer endless fabric means 12 defines a closed loop in which are situated guide rolls 14 for the endless fabric means 12. The inner endless fabric means 11 also has an inner surface defining a closed loop, and within this closed loop there are a number of guiding rolls 15 for the endless fabric means 11, although there are also some guiding rolls 15 situated outside of the closed loop of the endless fabric means 11, in engagement with the outer surface thereof. In the event that the inner and outer endless fabric means 11 and 12 take the form of felts, there will be provided a conditioning apparatus for these felts, but such a conditioning apparatus has not been illustrated.

The outer surfaces of the inner and outer endless fabric means 11 and 12 define between themselves a converging space where the inner and outer endless fabric means travel toward the forming roll means 13 to start their common path of travel where the twin-wire web formation starts. It will be noted that in the particular example illustrated at this converging space the outer surface of the outer endless fabric means 12 is directed upwardly, and the hydraulic headbox means 10 deposits the pulp stock initially on this outer surface of the outer endless fabric means 12 where the latter outer surface is directed upwardly so as to provide in this way a single-wire web formation before the twin-wire web formation takes place. In this way it is possible to provide a longer draining region for the web particularly during the initial stage of formation thereof. Thus it will be seen that the illustrated structure includes a single-wire web-forming portion **11*a* where draining of the deposited pulp stock is initiated, this single-wire web formation starting from the point O at the breast roll 14*a* and continuing up to the point C where twin-wire web formation starts, the web W having its initial stage of formation at this region 11***a*.

After this initial part 11*a* of the draining region where single-wire web formation takes place there is within the loop of the wire 12 a dewatering means 21 which in the illustrated example takes the form of a forming board to promote dewatering action in a well-known manner by foil action and/or suction. Thus, at the location B the deposited pulp stock will undergo an effective dewatering action. An adjusting means 20 has been schematically illustrated as operatively connected with the hydraulic headbox means 10 so as to be capable of adjusting the size of the lip slice through which the pulp stock issues onto the outer surface of the endless fabric means 12 to initiate the single-wire web formation. By way of the adjusting means 20 it is possible not only to control the size of the lip slice but also to control the direction of the issuing jet of pulp stock with respect to the wire.

From the location C where twin-wire web formation starts up to the location E where the twin-wire web formation ends, the pair of endless fabric means 11 and 12 lap the forming roll means 13 through the sector $\alpha$ so that twin-wire web formation takes place at the region D where the inner and outer endless fabric means 11 and 12 lap the forming roll means 13. At this location the web is under compression between the inner fabric means 11 and the outer endless fabric means 12, with dewatering taking place primarily by the action of a drainage pressure generated by centrifugal force (kinetic energy). The order of magnitude of the angle $\alpha$ by which the forming roll means 13 is lapped by the pair of endless fabric means 11 and 12 is appropriately 180°.

Of the several guide rolls for the outer endless fabric means 12, at least the roll 14*b* is supported so as to have its location capable of being adjusted, the adjusting means being indicated by the double-headed curved arrow passing through the roll 14*b*, so that in this way the degree of vacuum at the upper tangential point between the outer endless fabric means 12 and the forming roll means 13 (the location E) can be adjusted. By controlling this vacuum it is possible to influence the detachment of the web W from the outer endless fabric means 12 so as to assure that the web W follows the endless fabric means 11 when travelling beyond the location E. Thus it will be seen that at the region F the inner and outer endless fabric means 11 and 12 diverge from each other to define between themselves a diverging space where the outer surface of the endless fabric means 11 is directed upwardly, and the web W now is carried beyond the forming roll means 13 while resting on the upper outer surface of the endless fabric means 11. This reliable web transfer without any additional suction means can only be achieved by gradually increasing the draining pressure, and in this way a greater dry-matter content of the web W is achieved than in the case of previously known full throat formers.

The web W that has thus been formed is transferred in accordance with the invention while adhering to the upper outer surface of the endless fabric means 11, away from the region where twin-wire web formation takes place, and it will be seen that the web W at this time is fully supported, without any open draw, on the outer surface of the endless fabric means 11 while travelling substantially horizontally along a substantially straight path, without any intermediate steps or without any pick-up means or dewatering means additional to the fabric means being required.

In this way the web W is transferred to the press section of the illustrated paper machine. This press section includes an inner press roll 21 which defines with an outer press roll 22 of the press section the first press nip $N_1$. The inner press roll 21 of course engages the inner endless fabric means 11 at its inner surface within the loop thereof. Thus, with the above-described machine of the invention the web, in accordance with an important feature of the invention, is delivered without any intermediate steps directly to the first press nip of the press section after being formed in the manner described above.

With respect to the press section, the inner or lower press roll 21 is an efficiently dewatering roll inasmuch as it has a surface formed with spaces or recesses. Thus, for example, the dewatering press roll 21 can be formed at its outer surface with grooves or may have a number of blind bores extending partly through the thickness of the shell of the roll 21 inwardly from the outer surface thereof. However it is also possible for the roll 21 to take the form of a wire-coated roll, or any roll having water-receiving spaces at its outer surface.

The upper or outer press roll 22 at the first press nip $N_1$ is a suction roll having a suction zone 22 $\alpha$. Thus, at this first press nip $N_1$ there is a substantially symmetrical dewatering in both directions.

An endless fabric means 28 laps around the upper press roll 22 so that the web W at the first press nip is situated between the endless fabric means 11 and the endless fabric means 28. The endless fabric means 28 may take the form, for example, of a suitable felt. This endless fabric means 28 is guided as schematically illustrated by guide rolls 27. Thus, as set forth above, dewatering at the first press nip $N_1$ is symetrical, inasmuch as it takes place simultaneously in opposite directions, and the first suction zone 22 $\alpha$ provided at the upper or outer press roll 22 also contributes to the assurance that the web W is reliably detached from the endless fabric means 11 when travelling beyond the first press nip $N_1$. Thus beyond the first press nip $N_1$ the web W travels with the endless fabric means 28 while being at all times fully supported, which is to say while travelling in closed conduction without any open draw, and in this way the web reaches the second press nip $N_2$ where the press roll 22 has a further suction zone 22 $\beta$.

As illustrated in the drawing, the second press nip $N_2$ is defined by the outer press roll 22 and a rotary drying cylinder 45 of the drying section of the machine. This rotary cylinder 45 is a Yankee cylinder, the hood 47 which cooperates with the Yankee cylinder 45 being schematically illustrated. In some cases it is possible also to provide a third press nip at the Yankee cylinder 45, but such a third press nip is not required and is not illustrated.

Thus, at the Yankee cylinder 45 the web W is detached from the fabric means 28 and travels with the Yankee cylinder 45 which rotates in a clockwise direction, as viewed in the drawing. When the web travels on the cylinder 45 beyond the hood 47, it is detached from the cylinder 45 by a doctor blade 46 which, as is well known, provides a creping action, the illustrated structure being particularly suitable for manufacturing tissue paper, as pointed out above. The web W removed by the doctor blade 46 is of course further guided as schematically illustrated at the right of the drawing beyond the cylinder 45 to suitable rolls where further treatment takes place in a well known manner.

In the particular example illustrated in the drawing, the outer press roll 22 is lapped by an additional endless fabric means which includes not only the endless fabric means 28 but also the endless fabric means 30 which is shown by way of a dot-dash line illustration. This endless fabric means 30 is in the form of a wire suitable for pattern embossing, the wire 30 lapping the roll 22 together with the felt 28 which is situated between the roll 22 and the wire 30. By means of this wire 30 it is possible to enhance properties which are important particularly in tissue paper, so that it is possible to provide the tissue paper with superior bulk, strength, and absorptivity. This wire 30 has a relatively open mesh and it produces impressions in the paper at the press nips $N_1$ and $N_2$. At the locations where the web W has thus been pressed, there will be an increased strength of the paper, while those areas of the paper which have not been contacted by the wire 30 will remain prominent, thus increasing the bulk and absorptivity of the paper. By way of this construction, which also is an important part of the invention, a structurally compact and inexpensive design is achieved. The wire 30 is guided by the illustrated rolls 31, the drawing also illustrating schematically a conditioning apparatus 32 for the wire 30.

Thus, at the first press nip $N_1$, the web W will travel between the endless fabric means 11 and the additional fabric means formed by the endless fabrics 28 and 30, with embossing taking place by way of the wire 30 as set forth above. At the second press nip $N_2$, the web travels between the drying cylinder 45 and the additional endless fabric means 28, 30 with the embossing pressure also being provided by the wire 30 at this second press nip $N_2$.

Of course, the invention is not to be confined to the specific details presented above merely by way of example. The invention of course may vary within the scope of the inventive concept defined by the claims which follow.

What is claimed is:

1. In a paper-manufacturing machine, twin wire former means including a rotary, smooth surfaced forming roll means and inner and outer endless fabric means lapped around said forming roll means with said inner endless fabric means being situated at said forming roll means between the latter and said outer endless fabric means for carrying out twin-wire web formation between said inner and outer fabric means where they are lapped around said forming roll means, each of said endless fabric means having an inner surface defining a closed loop and an outer surface directed away from said closed loop with twin-wire web formation taking place between said outer surfaces of said endless fabric means where the latter are lapped around said forming roll means, said inner and outer endless fabric means defining between said outer surfaces thereof where said inner and outer fabric means approach said forming roll means a converging space leading toward a starting end of a common path of travel of said inner and outer endless fabric means around said forming roll means where twin-wire web formation is initiated, and one of said endless fabric means having at said converging space an upwardly directed outer surface, headbox means for depositing pulp stock on the latter upwardly directed outer surface for providing for single-wire web formation on the latter upwardly directed outer surface prior to twin-wire web formation whereby an initial dewatering action takes place during the single-wire web formation prior to further dewatering during the twin-wire web formation, said outer surfaces of said inner and outer endless fabric means defining between themselves a diverging space where said inner and outer endless fabric means travel away from said smooth surfaced forming roll means from a location where said inner and outer fabric means travel apart from each other at the end of the twin-wire formation where the end of the lapping of said forming roll means by said inner and outer endless fabric means is situated, and one of said endless fabric means having at said diverging space an upwardly directed outer surface on which the web formed during twin-wire formation rests while travelling beyond said smooth surfaced forming roll means, a press section including an inner press roll situated within the loop of that one of said endless fabric means which carries the web beyond said forming roll means and engaging the latter endless fabric means, said press section including an outer press roll situated at the outside of the latter loop and cooperating with said inner press roll to define therewith the first nip of the press section, said one of said endless fabric means which carries the web beyond said forming roll means comprising means for transporting said web from said smooth surfaced forming roll means substantially horizontally along a substantially straight path to said first press nip in the absence of the application of any suction means, pick-up means or additional dewatering means to said web, and additional endless fabric means lapped around said outer press roll for providing for the web at said first press nip a path of travel between said additional endless fabric means and the endless fabric means engaging said inner press roll, said web travelling beyond said first nip with said additional endless fabric means around said outer press roll to become detached from said endless fabric means which carries the web beyond said forming roll means only after said first press nip of said press section, and a drying section including at least one rotary drying cylinder cooperating with said outer press roll for defining with the latter at least a second press nip where the web is detached from said additional endless fabric means to travel around said drying cylinder in said drying section.

2. The combination of claim 1 and wherein the paper-manufacturing machine is adapted to manufacture tissue paper, said drying cylinder being a Yankee cylinder.

3. The combination of claim 1 and wherein a dewatering means is situated within the loop of that one of said fabric means which receives the pulp stock from said headbox means to provide for single-wire web formation prior to said twin-wire web formation, said dewatering means being situated next to the inner surface of the latter endless fabric means at a portion thereof where the single-wire web formation takes place.

4. The combination of claim 3 and wherein said dewatering means includes a forming board.

5. The combination of claim 1 and wherein said single-wire web formation takes place in advance of said twin-wire web formation at said outer endless fabric means.

6. The combination of claim 1 and wherein said inner endless fabric means carries the web subsequent to twin-wire formation to said press section.

7. The combination of claim 1 and wherein said additional endless fabric means includes a pair of endless fabric means both of which are lapped around said outer press roll with one of said pair of endless fabric means being situated at said outer press roll between the latter and the other of said pair endless fabric means, said other of said pair of endless fabric means being an embossing endless fabric means for embossing a given pattern on the web.

8. The combination of claim 1 and wherein said inner press roll is a dewatering roll having an outer surface formed with spaces for receiving water from the web at said first press nip.

9. The combination of claim 8 and wherein said outer press roll is a suction roll.

10. The combination of claim 9 and wherein said inner press roll is situated beneath said outer press roll.

* * * * *